US009382686B2

(12) United States Patent
Friedrich

(10) Patent No.: US 9,382,686 B2
(45) Date of Patent: Jul. 5, 2016

(54) QUICK COUPLER

(71) Applicant: KINSHOFER GmbH, Waakirchen (DE)

(72) Inventor: Thomas Friedrich, Schliersee (DE)

(73) Assignee: KINSHOFER GMBH, Waakirchen (DE)

( * ) Notice: Subject to any disclaimer, the term of this patent is extended or adjusted under 35 U.S.C. 154(b) by 417 days.

(21) Appl. No.: 13/945,723

(22) Filed: Jul. 18, 2013

(65) Prior Publication Data

US 2014/0030005 A1 Jan. 30, 2014

(30) Foreign Application Priority Data

Jul. 24, 2012 (DE) ..... 20 2012 007 124 U
Oct. 15, 2012 (DE) ..... 20 2012 009 838 U

(51) Int. Cl.
*E02F 3/36* (2006.01)
*E02F 9/22* (2006.01)

(52) U.S. Cl.
CPC ..... *E02F 3/3663* (2013.01); *E02F 3/365* (2013.01); *E02F 9/2225* (2013.01); *E02F 9/2296* (2013.01); *Y10T 403/22* (2015.01)

(58) Field of Classification Search
CPC ..... E02F 3/3663; E02F 3/365; E02F 3/3609
See application file for complete search history.

(56) References Cited

U.S. PATENT DOCUMENTS 6,231,296 B1 * 5/2001 Blomgren ..... E02F 3/3631 37/468
7,047,866 B2 * 5/2006 Fatemi ..... E02F 3/365 91/1
7,367,256 B2 * 5/2008 Fatemi ..... E02F 3/365 91/1
7,426,796 B2 * 9/2008 Cunningham ..... E02F 3/3618 37/234
2004/0244575 A1 * 12/2004 Fatemi ..... E02F 3/365 91/459
2006/0037220 A1 * 2/2006 Cunningham ..... E02F 3/3618 37/468
2007/0130932 A1 * 6/2007 Fatemi ..... E02F 3/365 60/459
2008/0067784 A1 * 3/2008 Calvert ..... E02F 3/3622 280/507
2010/0061799 A1 * 3/2010 Hill ..... E02F 3/3645 403/322.3
2011/0010915 A1 * 1/2011 Calvert ..... E02F 3/3622 29/428
2011/0088795 A1 * 4/2011 Hill ..... E02F 3/3663 137/557

* cited by examiner

*Primary Examiner* — Matthew D Troutman
(74) *Attorney, Agent, or Firm* — Troutman Sanders LLP; Ryan A. Schneider; Daniel T. Sharpe

(57) ABSTRACT

A quick coupler for coupling a tool like for example a scoop, shell grab or demolition tongs to a tool guide such as an excavator arm or the like, including a coupling receptacle for receiving a first locking part and a locking receptacle for receiving a second locking part, wherein to the coupling receptacle a self-locking securing element is associated for catching and/or securing the first locking part in the coupling receptacle, and to the locking receptacle a pressure-medium-actuatable locking element is associated for locking the second locking part in the locking receptacle. The self-locking securing element of the coupling receptacle likewise is actuatable by the pressure circuit.

21 Claims, 3 Drawing Sheets

QUICK COUPLER

CROSS-REFERENCE TO RELATED APPLICATIONS

This application claims the benefit of German Utility Model Application No. 20 2012 007 124.6 filed 24 Jul. 2012 and German Utility Model Application No. 20 2012 009 838.1 filed 24 Jul. 2012 filed 15 Oct. 2012, the entire contents and substance of which are hereby incorporated by reference.

BACKGROUND OF THE INVENTION

1. Field of Invention

The present invention relates to a quick coupler for coupling a tool like for example a scoop, shell grab or demolition tongs to a tool guide such as an excavator arm or the like, comprising a coupling receptacle for receiving a first locking part and a locking receptacle for receiving a second locking part, wherein to the coupling receptacle a preferably self-locking securing element is associated for catching and/or securing the first locking part in the coupling receptacle and to the locking receptacle a pressure-medium-actuatable locking element is associated for locking the second locking part in the locking receptacle.

2. Background and Related Art

On construction machines such as hydraulic excavators or joint grabs such as wood handling machines or demolition equipment or similar material handling machines there are frequently used quick couplers for coupling various tools such as buckets, shell grabs or demolition tongs to an excavator arm or similar tool guides such as articulated arm booms, in order to be able to use various tools without long retooling times. As locking elements, such quick couplers in particular can include two spaced locking axles on one coupling part, whereas the other coupling part, in particular the excavator-arm-side coupling part, can include a preferably hook-shaped coupling receptacle for hooking into a first one of the two locking axles and a locking receptacle for locking at the second locking axle. After hooking the first locking axle into the coupling receptacle, the two coupling parts can be pivoted relative to each other, wherein the locking axle sitting in the coupling receptacle forms the axis of rotation, so that the second locking axle moves into the locking receptacle or is swiveled into the same, where the second locking axle then can be locked by a locking element such as for example an extendable wedge, so that at the same time it is no longer possible either to move the first locking axle out of the coupling receptacle. The locking axles on the one coupling part can be formed by locking bolts which on the corresponding coupling part can extend in particular parallel to each other, wherein instead of such bolts, however, other structural parts of the coupling part such as protruding noses, knuckles, engagement stubs in the form of protrusions or recesses for example in the form of pockets also can serve as locking part, which are adapted to the shape of the coupling receptacle or the locking receptacle of the other coupling part.

To prevent the first locking axle from again being released from the coupling receptacle during the swiveling operating after hooking the first locking axle into the coupling receptacle, it has been proposed already to associate a securing element for example in the form of a spring-tensioned snap-in wedge to the coupling receptacle, which on hooking the locking axle into the coupling receptacle catches the locking axle and secures the same in the coupling receptacle. When the locking axle moves into the coupling receptacle, the safety catch is pushed back, until the position completely hooked in is reached, so that the safety catch can again snap back and block the path of movement out of the coupling receptacle. To be able to also move the first locking axle out of the coupling receptacle or unhook the same when demounting a tool after unlocking the locking receptacle, this securing element must again be released or be moved into its clearing position. This can be effected with actuation by a pressure medium, for example by a single-acting pressure medium cylinder, which is able to move the securing element against its spring bias into the locking or blocking position and back into the clearing position. Climbing down of the machine operator or a manual operation thereby can be avoided.

To make the actual locking mechanism, which in operation is transmitting power and by which the second locking element for example in the form of a locking axle is fixed or locked in the locking receptacle, independent of the actuation of the securing element associated to the coupling receptacle, clearing or releasing the securing element at the coupling receptacle is accomplished by a separate pressure medium circuit, which is controllable independent of the pressure medium circuit for actuating the locking mechanism or is formed separate therefrom. This decoupling is performed to prevent that disturbances at the securing element cannot pass over to the actual locking mechanism and during operation can effect an unwanted release of the coupler lock. Such disturbances for example might be pressure losses at sealing elements, for example, which are provided in pressure circuit portions leading to the securing element of the coupling receptacle. Such quick coupler with separate pressure circuits decoupled from each other for actuating the locking mechanism and for unlocking the securing element at the coupling receptacle are shown for example in the document EP 1852555 A2.

Since in practice in the past frequently sold quick couplers of the type, which still are in use, have not been provided with such additional securing element at the coupling receptacle, it would be desirable to not only provide such additional lock at the coupling receptacle of new appliances, i.e. new quick couplers, but also to be able to retrofit the same at old quick couplers. The solution shown in the document EP 1852555 A2 is also suitable in principle for retrofitting already existing quick couplers, but due to the separate pressure circuit for actuating the securing element of the coupling receptacle it requires three hydraulic ports, namely two ports for actuating the actual locking mechanism and a further pressure port for unlocking the securing element of the coupling receptacle. However, only two hydraulic pressure ports frequently are present on existing appliances, so that retrofitting with such additional lock at the coupling receptacle often is not possible.

BRIEF SUMMARY OF THE INVENTION

Briefly described, in a preferred form, the present invention comprises an improved quick coupler of the type mentioned above, which avoids the disadvantages of the prior art and develops the latter in an advantageous way. In particular, there should be created an easily actuatable additional lock at the coupling receptacle, which does not require an increased number of pressure medium ports.

In an exemplary embodiment, the present invention comprises a quick coupler comprising a coupling receptacle for receiving a first locking part, the coupling receptacle having a self-locking securing element for one or both of catching or securing the first locking part in the coupling receptacle, a locking receptacle for receiving a second locking part, the locking receptacle having a pressure-medium-actuatable locking element for locking the second locking part in the locking receptacle, a pressure circuit actuating the self-locking securing element and the pressure-medium-actuatable locking element, the pressure circuit having an unlocking pressure port, a locking pressure port, a valve means selectively connectable with one of a pressure source or a return line, and a pressure control means, wherein the self-locking securing element is connected with the unlocking pressure port via a first switching valve that opens upon reaching/exceeding a first pressure, and wherein the pressure control means selectively controls the pressure applied at the unlocking pressure port to a second pressure greater than the first pressure and to a third pressure less than the first pressure.

The pressure control means can be formed such that the actuation of the self-locking securing element of the coupling receptacle is effected at a higher pressure than the actuation of the pressure-medium-actuatable locking element of the locking receptacle.

A portion of the pressure circuit leading to the self-locking securing element can be shut off from the rest of the pressure circuit upon actuation of the pressure-medium-actuatable locking element with a lower pressure.

The pressure control means can include a pressure reducing valve for reducing the second pressure to the third pressure and a second switching valve provided upstream of the pressure reducing valve, which second switching valve in a first switching position applies the second pressure to the pressure reducing valve and in a second switching position applies the second pressure past the pressure reducing valve to the unlocking pressure port.

The valve means can be downstream of the pressure reducing valve and include a third switching valve, which third switching valve in a first switching position passes the third pressure reduced by the pressure reducing valve to the locking pressure port and in a second switching position passes the third pressure reduced by the pressure reducing valve to the unlocking pressure port.

The second switching valve can be connected with the unlocking pressure port via a first check valve that prevents a back flow from the unlocking pressure port.

The second switching valve can be connected with the unlocking pressure port via a first check valve that prevents a back flow from the unlocking pressure port.

The first check valve can be provided in a bypass line around the pressure reducing valve between the second switching valve provided upstream of the pressure reducing valve and the third switching valve provided downstream of the pressure reducing valve.

Between the second and third switching valves a second check valve can be provided for locking and unlocking the pressure-medium-actuatable locking element that prevents a back flow towards the second switching valve.

The self-locking securing element can be connected with one or both of the unlocking pressure port and the locking pressure port past the first switching valve via at least one of a third check valve and a fourth check valve, wherein the at least one third and fourth check valves prevent a fluid flow from one or both of the unlocking pressure port and the locking pressure port towards the self-locking securing element.

The self-locking securing element can be connected with one or both of the unlocking pressure port and the locking pressure port past the first switching valve via at least one of a third check valve and a fourth check valve, wherein the at least one third and fourth check valves permits only a back flow from the self-locking securing element towards one or both of the unlocking pressure port and the locking pressure port.

A flow impeder can be located between the at least one third and fourth check valves and the self-locking securing element. The flow impeder can comprise an orifice plate.

Past the first switching valve a first and a second return line connected in parallel with one of the third and fourth check valves, respectively, can be provided, wherein one of the first and second return lines is connected with the locking pressure port, and wherein the other of the first and second return lines is connected with the unlocking pressure port.

The valve means can include a pressure reducing valve associated to the locking pressure port for reducing the pressure provided for locking the pressure-medium-actuatable locking element to a fourth pressure lower than the third pressure provided for unlocking the pressure-medium-actuatable locking element.

Between the locking pressure port and the pressure-medium-actuatable locking element a fifth check valve preventing the back flow from the pressure-medium-actuatable locking element to the locking pressure port can be provided, which can be unlocked by the third pressure provided at the unlocking pressure port for unlocking the pressure-medium-actuatable locking element.

The self-locking securing element of the coupling receptacle can be biased into a locking position by a biasing device and can be unlocked against the bias by a pressure medium cylinder.

In another exemplary embodiment of the present invention, a quick coupler for coupling a tool to an excavator arm or the like comprises a coupling receptacle for receiving a first locking part and a locking receptacle for receiving a second locking part, wherein to the coupling receptacle a preferably self-locking securing element is associated for catching and/or securing the first locking part in the coupling receptacle, and to the locking receptacle a pressure-medium-actuatable locking element is associated for locking the second locking part in the locking receptacle, wherein the locking element is actuatable by a pressure circuit which includes an unlocking pressure port and a locking pressure port, which via a valve means are selectively connectable with a pressure source or a return line, wherein the securing element of the coupling receptacle likewise is actuatable by the pressure circuit, wherein the securing element is connected with the unlocking pressure port via a pressure switching valve, which opens upon reaching/exceeding a predetermined first pressure, and the valve means of the pressure circuit includes a pressure control means for selectively controlling the pressure applied at the unlocking pressure port to a second pressure greater than the first pressure and to a third pressure smaller than the first pressure.

Hence, it is proposed to actuate the actual locking means at the locking receptacle of the quick coupler, which in operation is transmitting power, and the additional lock at the coupling receptacle by a common pressure circuit and to form the common pressure circuit such that the actuation of the additional lock of the coupling receptacle and the actuation of the locking mechanism at the locking receptacle is effected at different pressure levels, in particular such that the additional lock of the coupling receptacle only is actuatable and/or connectable to the rest of the pressure circuit when a pressure sufficient or provided for the actuation of the actual locking means is exceeded or such excessive pressure is applied to the pressure circuit portion leading to the additional lock. According to the invention, the securing element of the coupling receptacle likewise is actuatable by the pressure circuit which as such is provided for actuating the locking element of the locking receptacle, wherein the securing element is connected with the unlocking pressure port of the pressure circuit via a pressure switching valve, which opens upon reaching/exceeding a predetermined first pressure, and the valve means of the pressure circuit includes a pressure control means for selectively controlling the pressure applied at the unlocking pressure port to a second pressure greater than the first pressure and to a third pressure smaller than the first pressure. It can be achieved by the pressure switching valve that the additional lock at the coupling receptacle only is connected to the pressure circuit for actuating the locking mechanism when the pressure circuit at the unlocking pressure port provides the increased second pressure, which lies above the switching pressure of the pressure switching valve. However, when the pressure circuit operates in its locking/unlocking mode for the locking element at the locking receptacle, and at the unlocking pressure port and preferably also at the locking pressure port provides a pressure level which lies below the switching pressure of the pressure switching valve, the additional lock at the coupling receptacle remains uninvolved and cut off by the pressure switching valve. By connecting the additional lock of the coupling receptacle and the locking mechanism of the locking receptacle to the common pressure circuit, the quick coupler as a whole can do with only two pressure ports despite the additional lock at the coupling receptacle. Nevertheless, it is ensured by the provided actuation at different pressure levels that the additional lock at the coupling receptacle does not open unintentionally already before locking at the locking receptacle, or damages at the additional lock might lead to a malfunction of the locking mechanism in working operation.

In accordance with a development of the invention, the differently high pressure levels for actuating the securing element of the coupling receptacle on the one hand and the locking element of the locking receptacle on the other hand can be achieved by at least one pressure reducing valve, which selectively can be bypassed by an upstream directional or switching valve or can be connected into the flow path, so that a pressure reduced by the pressure reducing valve or a pressure not reduced by the pressure reducing valve selectively can be applied to the unlocking pressure port. As an alternative to such bypass solution with a switching valve it would likewise be possible to use a pressure reducing valve variable or controllable in terms of the pressure reduction, so that in this case a directional valve provided upstream of the pressure reducing valve possibly might be omitted. The bypass solution with an upstream directional valve, however, allows a reliable adjustment of two defined pressure levels sufficiently spaced from each other, by means of which a defined switching on or off of the securing element of the coupling receptacle can be achieved in conjunction with the aforementioned pressure switching valve. In particular, the aforementioned pressure control means can include a pressure reducing valve which reduces the second pressure, which lies above the switching pressure of the pressure switching valve and is provided for actuating the securing element of the coupling receptacle, to the third pressure which is smaller than the switching pressure of the pressure switching valve and is provided for actuating the locking element of the locking receptacle. In a first switching position, the switching valve provided upstream of the pressure reducing valve can apply an input pressure, which can correspond to the second pressure and/or can be provided by pressure source, to the pressure reducing valve, and in a second switching position can apply the input pressure past the pressure reducing valve to the unlocking pressure port. "Upstream" here refers to the fact that the switching valve is arranged between a pressure source or a pressure source port and the pressure reducing valve, so that pressure coming from the pressure source or pressure fluid coming from the pressure source first flows through the switching valve, before the pressure reducing valve is reached.

To be able to selectively apply the pressure reduced by the pressure reducing valve to the unlocking pressure port or to the locking pressure port, the valve means on the output side of the pressure reducing valve according to a development of the invention can comprise a directional or switching valve which in a first switching position passes the pressure reduced by the pressure reducing valve to the locking pressure port and in a second switching position passes the pressure reduced by the pressure reducing valve to the unlocking pressure port. By switching over this switching valve, the unlocking side or the locking side of the actuator associated to the locking element of the locking receptacle selectively can be pressurized, so that the lock can be released or closed selectively.

In accordance with a development of the invention, a further pressure reducing valve can be associated to the locking pressure port, so that the pressure reduced already by the aforementioned first pressure reducing valve is reduced again and the locking of the locking element of the locking receptacle is effected with a lower pressure than unlocking. Thus, the pressure circuit advantageously can be formed such that during locking the locking element is operated at another pressure level than during unlocking, wherein advantageously unlocking is accomplished with a higher pressure than locking.

To prevent that when unlocking the locking element of the locking receptacle the pressure applied to the unlocking pressure port via the pressure reducing valve and the downstream switching valve unimpededly can flow back into the tank via the switching valve upstream of the pressure reducing valve, a check valve can be provided between the switching valve, which is provided upstream of the pressure reducing valve, and the unlocking pressure port in accordance with a development of the invention, which check valve preferably can be arranged between the two switching valves which are provided upstream and downstream of the pressure reducing valve. Alternatively or in addition to such check valve, the switching valve provided upstream of the pressure reducing valve also might be equipped with additional switching positions, for example such that when switching the input pressure through to the pressure reducing valve, the channel to the unlocking pressure port is blocked.

To furthermore prevent that when for actuating the actuator of the securing element the full system pressure is applied to the unlocking line via the switching valve upstream of the pressure reducing valve, the pressure escapes towards the tank via the other switching valve then open towards the tank, which is provided downstream of the pressure reducing valve, a further check valve can be provided in accordance with a development of the invention between the two switching valves—upstream or downstream of the pressure reducing valve—in the line connected with the tank in this switching configuration, which check valve blocks towards the tank.

To provide for a return of the securing element of the coupling receptacle in particular into the locking position and/or provide for a back flow of the pressure fluid from the securing element of the coupling receptacle after actuation has been effected, at least one relief line can be provided at the aforementioned pressure switching valve in accordance with a development of the invention, which relief line preferably connects the actuator of the securing element past the pressure switching valve with the locking pressure port and/or the unlocking pressure port of the pressure circuit. To prevent the pressure fluid from flowing off too fast and to ensure the actuation of the securing element with open pressure switching valve, a flow impeder preferably in the form of an orifice plate can be provided in the return or relief line. Due to the relatively high pressure level upon actuation of the securing element it thereby is ensured that the actuator driving the securing element actually is actuated, while on the other hand with closed pressure switching valve a back flow, perhaps also slowly, or a pressure relief becomes possible via the orifice plate.

To on the other hand prevent an unwanted actuation of the securing element via the relief or return line, the actuator of the securing element according to a development of the invention can be connected both with the locking pressure port and with the unlocking pressure port via two relief lines each past the pressure switching valve, wherein in this case each of the relief lines can be traversed in relief direction only through a check valve. Due to the parallel connection of the two check valves and the corresponding relief lines, it is not only possible to accomplish the return of the pressure fluid from the actuator of the securing element, but it is prevented at the same time that with a defective check valve pressure is passed from the locking or unlocking line to the actuator of the securing element, since although such pressure can pass the defective check valve, it can be discharged directly via the second check valve connected in parallel, as in this case the second check valve is connected with the tank via the pressure-relieved unlocking or locking line.

These and other objects, features and advantages of the present invention will become more apparent upon reading the following specification in conjunction with the accompanying drawing figures.

BRIEF DESCRIPTION OF THE DRAWINGS

Various features and advantages of the present invention may be more readily understood with reference to the following detailed description taken in conjunction with the accompanying drawings, wherein like reference numerals designate like structural elements, and in which.

DETAILED DESCRIPTION OF THE INVENTION

Figure 1:
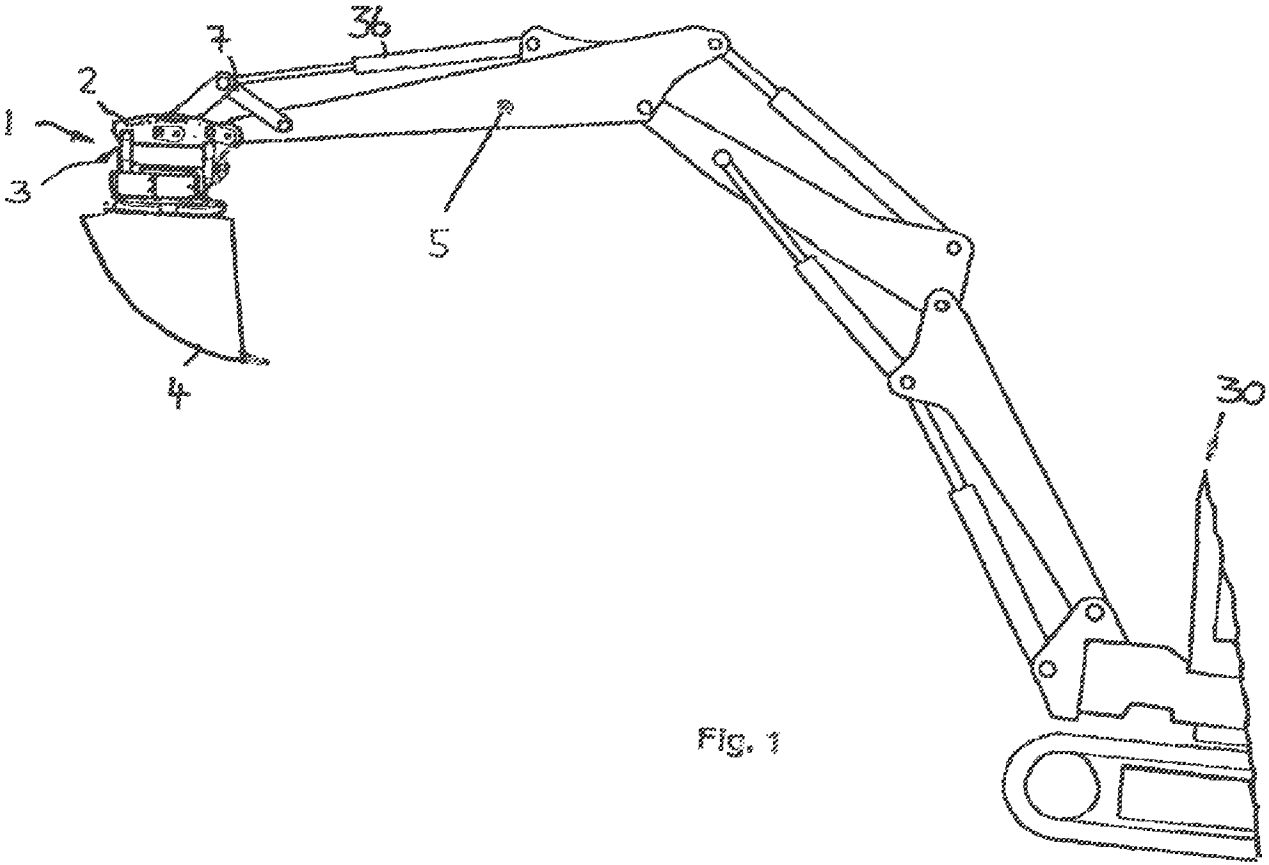
FIG. 1 shows a schematic side view of a quick coupler according to an advantageous embodiment of the invention, which is attached to a boom arm of an excavator and couples a bucket as attachment tool.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

As shown in FIG. 1, the quick coupler 1 can be mounted between the free end of the boom arm 5 of an excavator 30 and the tool 4 to be attached thereto, wherein in FIG. 1 the attachment tool 4 is formed as bucket, but in the usual manner can of course also comprise other corresponding construction, handling or demolition tools for example in the form of shell grabs, demolition tongs, shears or the like. By means of an arm-side coupler part 2, the quick coupler 1 on the one hand is pivotably mountable to the boom arm 5 about a horizontal swivel axis oriented transversely to the longitudinal axis of the boom arm 5, so that the quick coupler 1 together with the tool 4 attached thereto can be pivoted with respect to the boom arm 5 for example by means of a pressure medium cylinder 36 and an interposed pivot piece 7.

Figure 2:
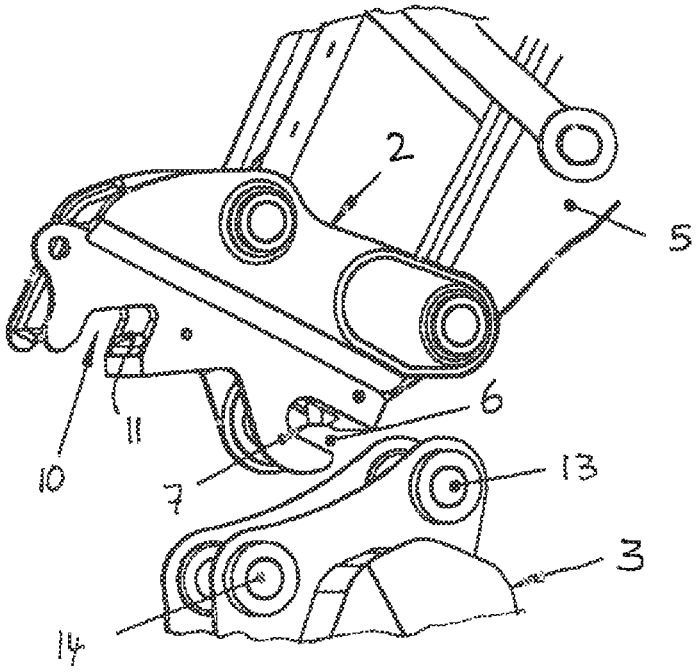
FIG. 2 shows a perspective representation of the quick coupler of FIG. 1 in a decoupled position in which the coupling parts to be coupled with each other are shown shortly before hooking in at the hook portion.

By means of a tool-side coupler part 3—cf. FIG. 2—the quick coupler on the other hand can be attached to the attachment tool 4 and/or an interposed slewing drive.

Figure 3:
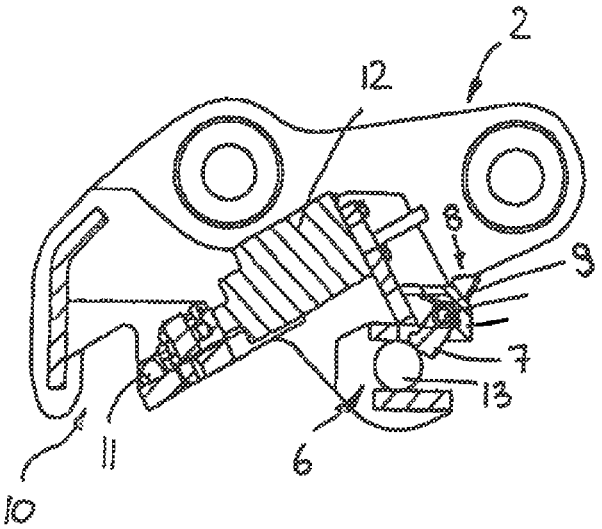
FIG. 3 shows a sectional view through the coupling part of the quick coupler of the preceding Figures, which shows the coupling receptacle and the locking receptacle as well as the associated securing and locking elements and their actuators.

As shown in FIGS. 2 and 3, one of the two coupler parts 2 and 3, preferably the arm-side coupler part 2 on the one hand can comprise a coupling receptacle 6 and on the other hand a locking receptacle 10, which can be hooked into or be brought in engagement with two locking parts, for example in the form of locking axles 13 and 14 at the other, preferably tool-side coupler part 3. Contrary to the representation of the drawing it would, however, also be conceivable in principle to provide a locking axle and a receptacle at one coupler part and in turn a locking axle and a receptacle at the other coupler part, wherein however the illustrated embodiment with two receptacles, i.e. locking receptacle and coupling receptacle at the one coupler part and two locking axles corresponding therewith at the other coupler part, is preferred, since the associated securing and locking elements and their actuation then can be combined at one coupler part.

As shown in FIG. 2, the coupling receptacle 6 and the locking receptacle 10 each form a jaw-like receptacle open towards one side, into which the locking axles 13 and 14 can move, which can be formed by transverse bolts or locking bolts, cf. FIG. 2. The coupling receptacle 6 and the locking receptacle 10 advantageously are arranged and configured such that when a first locking axle 13 of the one coupler part 3 is moved or hooked into the preferably hook-shaped coupling receptacle 6 of the other coupler part 2, the two coupler parts can be pivoted relative to each other, namely such that the coupling receptacle 6 or the locking axle 13 accommodated therein form the axis of rotation and due to the corresponding swivel movement the second locking axle 14 can move into the locking receptacle 10, so that the two coupler parts 2 and 3 can be coupled with each other in a two-stage coupling process. The coupling receptacle 6 first is hooked in at the first locking axle 13, so that then the locking receptacle 10 can be brought in engagement with the second locking axle 14 by pivoting the two coupler parts 2 and 3 relative to each other—which can be effected for example by actuating the aforementioned slewing cylinder 36.

When the second locking axle 14 has been moved into the locking receptacle 10, the second locking axle 14 is locked in the locking receptacle 10 or the locking receptacle 10 is closed, so that the second locking axle 14 can no longer get out. For this purpose, a locking element 11 is provided for example in the form of a locking wedge, which on the opening side of the locking receptacle 10 can be moved before the locking axle 14 accommodated therein, cf. FIG. 3. For actuating the locking element 11, a hydraulically actuatable actuator 12 advantageously is provided, which is directly or indirectly connected with the locking element 11 and advantageously is of the double-acting type, so that it can be moved back and forth.

Locking the locking element 11 not only holds the second locking axle 14 in the locking receptacle 10, but the two coupler parts 2 and 3 also are locked with each other, since the coupling receptacle 6 is formed such that the first locking axle 13 accommodated therein cannot get out of the coupling receptacle 6, when the second locking axle 14 is caught in the locking receptacle 10.

Nevertheless, a securing element 7 is associated to the coupling receptacle 6, by means of which the first locking axle 13 or a suitable locking part can be caught or secured or blocked in the coupling receptacle 6, so that the first locking axle 13 cannot inadvertently slip out of the coupling receptacle 6. This securing element 7 chiefly serves to prevent the first locking axle 13 from inadvertently slipping out of the coupling receptacle 6 during the aforementioned swivel movement during the coupling operation, as long as the two coupler parts 2 and 3 are not yet locked with each other by closing the locking element 11.

The securing element 7 likewise can be a wedge-shaped slide or also, as shown in FIG. 3, a pivotally mounted locking lever which in its locking position tapers or blocks the opening of the coupling receptacle 6 to such an extent that the first locking axle 13 cannot slip out, cf. FIG. 3. The securing element 7 advantageously is formed as self-locking catch which is biased into the locking position by a biasing device in particular in the form of a spring 9, but can automatically be pushed back when the first locking axle 13 moves into the coupling receptacle 6. When the locking axle 13 has completely or sufficiently been moved into the coupling receptacle 6, the securing element 7 can snap back into the locking position driven by the spring 9, so that the locking axle 13 is caught.

For releasing the securing element 7 for the purpose of decoupling, an actuator 8 in the form of a single-acting hydraulic cylinder is associated to the securing element 7, by means of which the securing element 7 can be moved or pivoted into its clearing position.

Figure 4:
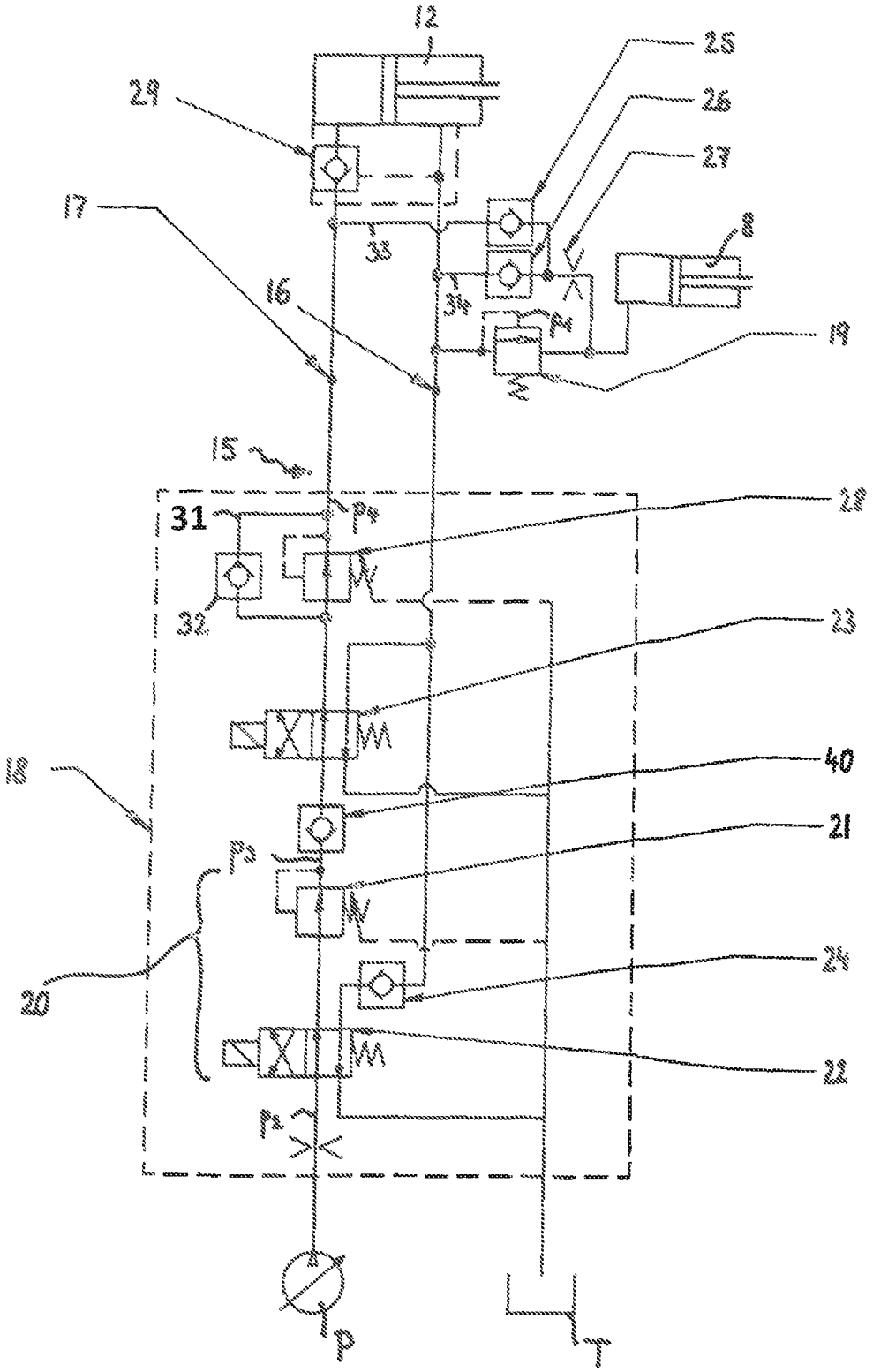
FIG. 4 shows a circuit diagram of the common pressure circuit for actuating the securing element associated to the coupling receptacle and the locking element associated to the locking receptacle.

The actuation of the two securing and locking elements 7 and 11 by a common pressure circuit 15 is shown in FIG. 4. The pressure circuit 15 on the one hand is connected with a pressure source P for example in the form of a pump, by means of which the pressure circuit 15 is fed with pressure fluid, in particular hydraulic pressure, and on the other hand connected with a tank T into which pressure fluid can flow back. On the other hand, the pressure circuit 15 comprises two pressure ports, namely on the one hand a locking pressure port 17 and on the other hand an unlocking pressure port 16, with which the double-acting actuator 12 of the locking element 11 is connected, in order to be able to release and close the locking of the quick coupler 1, i.e. to be able to lock and unlock the second locking axle 14 in the locking receptacle 10. To be able to control this main locking operation or unlocking operation, the pressure circuit 15 comprises a valve means 18 by means of which the unlocking pressure port 16 or the locking pressure port 17 selectively can be connected with the pressure source P.

As shown in FIG. 4, the valve means 18 for this purpose comprises a primary switching valve 23 which in one switching position switches the pressure line coming from the pressure source P to the locking pressure port 17 and the unlocking pressure port 16 to the tank, and in another switching position inversely connects the line coming from the pressure source P with the unlocking pressure port 16 and the locking pressure port 17 with the tank. In the line leading to the locking pressure port 17 a pressure reducing valve 28 is provided, so that the pressure used for locking is lower than the pressure used for unlocking. As shown in FIG. 4, the pressure reducing valve 28 advantageously is provided with a bypass 31 which is provided with a check valve 32, in order to bypass the resistance of the pressure reducing valve 28 during unlocking.

The actuator 8 provided for actuating the securing element 7 is connected to the unlocking pressure port 16 via a pressure switching valve 19, wherein the pressure switching valve 19 is formed such that at the pressure provided for unlocking the locking element 11 the securing element 7 is shut off from the remaining pressure circuit, i.e. the pressure switching valve 19 will only open at a pressure p1, which lies above the normal unlocking pressure for unlocking the locking element 11. To be able to adjust the various pressure levels for actuating the locking element 11 on the one hand and for actuating the securing element 7 on the other hand, the valve means 18 comprises a corresponding pressure control means 20 which according to the illustrated embodiment of FIG. 4 can comprise a pressure reducing valve 21 and a directional or switching valve or secondary switching valve 22 provided upstream of this pressure reducing valve 21. The pressure reducing valve 21 and the secondary switching valve 22 provided upstream of the same advantageously are provided upstream of the above-described primary switching valve 23, so that pressure coming from the pressure source P initially is applied to the secondary switching valve 22 and then to the pressure reducing valve 21, before the pressure reduced by the pressure reducing valve 21 then is applied to the primary switching valve 23.

At the switching position of the secondary switching valve 22 as shown in FIG. 4, the input pressure p2 coming from the pressure source P is connected through to the pressure reducing valve 21, in order to be reduced there and then be used by the primary switching valve 23 either for unlocking or locking the locking element 11. The pressure p3 reduced by the pressure reducing valve 21 is smaller than the switching pressure of the pressure switching valve 19, so that the securing element 7 remains shut off from the pressure circuit 15 or its pressurized portion. However, when the secondary switching valve 22 is moved into its other switching position, the pressure reducing valve 21 is bypassed and the full input pressure p2 is applied to the unlocking pressure port 16 from the pressure source P. The pressure switching valve 19 is formed and adjusted such that the switching pressure is smaller than the input pressure p2, so that in this case the pressure switching valve 19 opens and the pressure is applied to the securing element 7 or its actuator 8, whereby the coupling receptacle 6 is unlocked.

As shown in FIG. 4, a check valve 24 is provided in the main control block of the valve means 18, which check valve is provided between the secondary switching valve 22 and the unlocking pressure port 16 in the bypass line around the pressure reducing valve 21. Upon actuation of the primary switching valve 23 for unlocking the locking receptacle 10, this check valve 24 prevents an unwanted pressure loss via the still unactuated secondary switching valve 22 towards the tank T.

A further check valve is provided in the other connecting line between the secondary switching valve 22 and the primary switching valve 23, in order to prevent that at the switching condition for unlocking the securing element 7, i.e. for actuating the actuator 8, the pressure applied to the unlocking pressure port 16 inadvertently flows back via the primary switching valve 23 then open towards the tank. At this configuration, the full system pressure p2 is applied to the unlocking pressure port 16 via the then switched switching valve 22 past the pressure reducing valve 21, while on the other hand the primary switching valve 23 is switched into the unlocking position, so that the fully connected system pressure p2 might flow backwards so to speak via the primary switching valve 23 and the pressure reducing valve 21 to the tank, which however is prevented by the check valve 40. The check valve 40 can be provided upstream or also downstream of the pressure reducing valve 21 between the two switching valves 23 and 22.

As is furthermore shown in FIG. 4, further check valves 25 and 26 are provided in relief lines which by bypassing the aforementioned pressure switching valve 19 connect the actuator 8 of the securing element 7 with the unlocking pressure port 16 and the locking pressure port 17 and hence with the tank depending on the switching position of the main valve block, in order to provide for a back flow of the fluid pressed into the actuator 8. As shown in FIG. 4, the relief lines 33 and 34 each are equipped with a check valve 25 and 26, which check valves only allow a back flow of hydraulic fluid, but no pressurization of the actuator 8 from the pressurized pressure ports.

In principle, instead of the two relief lines 33 and 34 only one such relief line might be provided, in order to provide for a back flow of the fluid pressed into the actuator 8. The use of two such relief lines 33 and 34 together with the check valves 25 and 26 provided therein, in particular with a parallel arrangement of the two check valves, however increases the safety against an unwanted opening of the securing element 7 in the case of a defect of one of the two check valves 25 and 26. Should one of the check valves 25 or 26 have a malfunction and let fluid pressure through in direction of the actuator 8 of the securing element 7, this pressure always will be decreased immediately via the second check valve, since the respective other line, to which the other, second check valve is connected, i.e. the line or the port 16 or 17, necessarily is connected with the tank T. When pressure is applied to the one check valve from one of the ports 16 or 17, the respective other port 17 or 16 is pressureless and connected with the tank, so that the parallel connection of two check valves as shown in FIG. 4 on the back flow side of the actuator 8 significantly increases the safety against maloperation of the same.

To prevent the pressure fluid from flowing back too fast via the relief lines 33 and 34, in particular when the pressure switching valve is open, the relief lines 33 and 34 are provided with a flow impeder 27 in the form of an orifice plate, cf. FIG. 4.

The relief line 33 leading to the locking line provides for the relief of the hydraulic pressure in the actuator 8 of the securing element 7, as soon as the secondary switching valve 22 again is brought into the starting position and hence the safety means of the coupling receptacle 6 again is to be activated, i.e. is to be reset via the spring 9. Locking up of the pressure at this point, i.e. in the region of the actuator 8, thereby is prevented, as soon as the pressure switching valve 19 again closes due to the pressure in the unlocking line decreasing below the switching pressure. In addition, in this case the switching pressure always initially still exists in the unlocking line or the unlocking pressure port 16, so that a relief in this way would not be possible even without closing the pressure switching valve 19. In this case, however, the pressure on the locking pressure port and the still actuated primary switching valve 23 can be decreased towards the tank T.

The other relief line 34, which extends from the orifice plate to the unlocking line or to the unlocking pressure port 16, provides for a decrease in pressure when the primary switching valve 23 is again brought into the starting position shown in FIG. 4 simultaneously or very shortly after the secondary switching valve 22, for example by maloperation or power failure, against its intended normal operation. The pressure at the actuator 8 of the securing element 7 then can be decreased towards the tank T via the then open unlocking line or the still open unlocking pressure port 16 as well as the primary switching valve, cf. FIG. 4.

Thus, in preferred embodiments, the quick coupler for coupling the tool 4 to the excavator arm 5 or the like comprises the coupling receptacle 6 for receiving the first locking part 13 and the locking receptacle 10 for receiving the second locking part 14, wherein to the coupling receptacle 6 the preferably self-locking securing element 7 is associated for catching and/or securing the first locking part 13 in the coupling receptacle 6, and to the locking receptacle 10 the pressure-medium-actuatable locking element 11 is associated for locking the second locking part 14 in the locking receptacle 10, wherein the locking element 11 is actuatable by the pressure circuit 15 which includes the unlocking pressure port 16 and the locking pressure port 17, which via the valve means 18 are selectively connectable with the pressure source P or the return line T, characterized in that the securing element 7 of the coupling receptacle 6 likewise is actuatable by the pressure circuit 15, wherein the securing element 7 is connected with the unlocking pressure port 16 via the pressure switching valve 19, which opens upon reaching/exceeding the predetermined first pressure p1, and the valve means 18 of the pressure circuit 15 includes the pressure control means 20 for selectively controlling the pressure applied at the unlocking pressure port 16 to the second pressure p2 greater than the first pressure p1 and to the third pressure p3 smaller than the first pressure p1.

The pressure control means 20 is formed such that the actuation of the securing element 7 of the coupling receptacle 6 is effected at the higher pressure level than the actuation of the locking element 11 of the locking receptacle 10, wherein preferably the portion of the pressure circuit 15 leading to the securing element 7 is shut off from the rest of the pressure circuit 15 upon actuation of the locking element 11 with the intended lower pressure level.

The pressure control means 20 includes the pressure reducing valve 21 for reducing the second pressure p2 to the third pressure p3 and the switching valve 22 provided upstream of the pressure reducing valve 21, which switching valve 22 in the first switching position applies the input pressure p2 to the pressure reducing valve 21 and in the second switching position applies the input pressure p2 past the pressure reducing valve 21 to the unlocking pressure port 16.

The valve means 18 downstream of the pressure reducing valve 21 includes the further switching valve 23, which switching valve 23 in the first switching position passes the pressure p3 reduced by the pressure reducing valve 21 to the locking pressure port 17 and in the second switching position passes the pressure reduced by the pressure reducing valve 21 to the unlocking pressure port 16.

The switching valve 22 provided upstream of the pressure reducing valve 21 is connected with the unlocking pressure port 16 via the check valve 24 which prevents the back flow from the unlocking pressure port 16, wherein the check valve 24 preferably is provided in the bypass line around the pressure reducing valve 21 between the switching valve 22 provided upstream of the pressure reducing valve 21 and the switching valve 23 provided downstream of the pressure reducing valve 21.

Between the two switching valves 22, 23 which are provided upstream and downstream of the pressure reducing valve 21 the check valve 40 is provided in the line pressurized for locking and unlocking the locking element 11, which prevents the back flow towards the switching valve 22.

The securing element 7 is connected with the unlocking pressure port 16 and/or the locking pressure port 17 past the pressure switching valve 19 via at least one check valve 25, 26, wherein the at least one check valve 25, 26 prevents the fluid flow from the unlocking pressure port 16 and/or the locking pressure port 17 towards the securing element 7 and/or permits only the back flow from the securing element 7 towards the unlocking pressure port 16 and/or the locking pressure port 17.

Between the at least one check valve 25, 26 and the securing element 7 the flow impeder preferably in the form of the orifice plate 27 is provided.

Past the pressure switching valve 19 two return lines 33, 34 connected in parallel with one check valve 25, 26 each are provided, of which return lines one 33 is connected with the locking pressure port 17 and the other one 34 is connected with the unlocking pressure port 16.

The valve means 18 includes the pressure reducing valve 28 associated to the locking pressure port 17 for reducing the pressure provided for locking the locking element 11 to the pressure p4 smaller than the pressure p3 provided for unlocking the locking element 11.

Between the locking pressure port 17 and the locking element 11 the check valve 29 preventing the back flow from the locking element 11 to the locking pressure port 17 is provided, which can be unlocked by the pressure p3 provided at the unlocking pressure port 16 for unlocking the locking element 11.

The securing element 7 of the coupling receptacle 6 is biased into the locking position by the biasing device, in particular the spring means 9, and can be unlocked against the bias by the single-acting pressure medium cylinder 8, which is connected with the unlocking pressure port 16, and/or wherein the double-acting pressure medium cylinder 12 is associated to the locking element 11, which on the one hand is connected with the unlocking pressure port 16 and on the other hand with the locking pressure port 17.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A quick coupler comprising:

a coupling receptacle for receiving a first locking part, the coupling receptacle having a self-locking securing element for one or both of catching or securing the first locking part in the coupling receptacle;

a locking receptacle for receiving a second locking part, the locking receptacle having a pressure-medium-actuatable locking element for locking the second locking part in the locking receptacle;

a pressure circuit actuating both the self-locking securing element and the pressure-medium-actuatable locking element, the pressure circuit having:

an unlocking pressure port;

a locking pressure port;

a valve means selectively connectable with one of a pressure source or a return line; and a pressure control means;

wherein the self-locking securing element is connected with the unlocking pressure port via a first switching valve that opens upon reaching and subsequently exceeding a first pressure; and wherein the pressure control means selectively controls the pressure applied at the unlocking pressure port to a second pressure greater than the first pressure and to a third pressure less than the first pressure.

2. The quick coupler according to claim 1, wherein the pressure control means is formed such that the actuation of the self-locking securing element of the coupling receptacle is effected at a higher pressure than the actuation of the pressure-medium-actuatable locking element of the locking receptacle.

3. The quick coupler according to claim 1, wherein a portion of the pressure circuit leading to the self-locking securing element is shut off from the rest of the pressure circuit upon actuation of the pressure-medium-actuatable locking element with a lower pressure.

4. The quick coupler according to claim 1, wherein the pressure control means includes a pressure reducing valve for reducing the second pressure to the third pressure and a second switching valve provided upstream of the pressure reducing valve, which second switching valve in a first switching position applies the second pressure to the pressure reducing valve and in a second switching position applies the second pressure past the pressure reducing valve to the unlocking pressure port.

5. The quick coupler according to claim 1, wherein the pressure control means includes a pressure reducing valve for reducing the second pressure to the third pressure and a second switching valve provided upstream of the pressure reducing valve; and wherein the valve means is downstream of the pressure reducing valve and includes a third switching valve, which third switching valve in a first switching position passes the third pressure reduced by the pressure reducing valve to the locking pressure port and in a second switching position passes the third pressure reduced by the pressure reducing valve to the unlocking pressure port.

6. The quick coupler according to claim 1, wherein the pressure control means includes a pressure reducing valve for reducing the second pressure to the third pressure and a second switching valve provided upstream of the pressure reducing valve; and wherein the second switching valve is connected with the unlocking pressure port via a first check valve that prevents a back flow from the unlocking pressure port.

7. The quick coupler according to claim 1, wherein the pressure control means includes a pressure reducing valve for reducing the second pressure to the third pressure and a second switching valve provided upstream of the pressure reducing valve;

wherein the second switching valve is connected with the unlocking pressure port via a first check valve that prevents a back flow from the unlocking pressure port; and wherein the first check valve is provided in a bypass line around the pressure reducing valve between the second switching valve provided upstream of the pressure reducing valve and the third switching valve provided downstream of the pressure reducing valve.

8. The quick coupler according to claim 1, wherein the pressure control means includes a pressure reducing valve for reducing the second pressure to the third pressure and a second switching valve provided upstream of the pressure reducing valve;

wherein the valve means is downstream of the pressure reducing valve and includes a third switching valve wherein between the second and third switching valves a second check valve is provided for locking and unlocking the pressure-medium-actuatable locking element that prevents a back flow towards the second switching valve.

9. The quick coupler according to claim 1, wherein the self-locking securing element is connected with one or both of the unlocking pressure port and the locking pressure port past the first switching valve via at least one of a third check valve and a fourth check valve, wherein the at least one third and fourth check valves prevent a fluid flow from one or both of the unlocking pressure port and the locking pressure port towards the self-locking securing element.

10. The quick coupler according to claim 1, wherein the self-locking securing element is connected with one or both of the unlocking pressure port and the locking pressure port past the first switching valve via at least one of a third check valve and a fourth check valve, wherein the at least one third and fourth check valves permits only a back flow from the self-locking securing element towards one or both of the unlocking pressure port and the locking pressure port.

11. The quick coupler according to claim 1, wherein the self-locking securing element is connected with one or both of the unlocking pressure port and the locking pressure port past the first switching valve via at least one of a third check valve and a fourth check valve;

wherein a flow impeder is located between the at least one third and fourth check valves and the self-locking securing element.

12. The quick coupler according to claim 1, wherein the self-locking securing element is connected with one or both of the unlocking pressure port and the locking pressure port past the first switching valve via at least one of a third check valve and a fourth check valve;

wherein an orifice plate is located between the at least one third and fourth check valves and the self-locking securing element.

13. The quick coupler according to claim 1, wherein the self-locking securing element is connected with one or both of the unlocking pressure port and the locking pressure port past the first switching valve via at least one of a third check valve and a fourth check valve;

wherein past the first switching valve a first and a second return line connected in parallel with one of the third and fourth check valves, respectively, are provided;

wherein one of the first and second return lines is connected with the locking pressure port; and wherein the other of the first and second return lines is connected with the unlocking pressure port.

14. The quick coupler according to claim 1, wherein the valve means includes a pressure reducing valve associated to the locking pressure port for reducing the pressure provided for locking the pressure-medium-actuatable locking element to a fourth pressure lower than the third pressure provided for unlocking the pressure-medium-actuatable locking element.

15. The quick coupler according to claim 1, wherein between the locking pressure port and the pressure-medium-actuatable locking element a fifth check valve preventing the back flow from the pressure-medium-actuatable locking element to the locking pressure port is provided, which can be unlocked by the third pressure provided at the unlocking pressure port for unlocking the pressure-medium-actuatable locking element.

16. The quick coupler according to claim 1, wherein the self-locking securing element of the coupling receptacle is biased into a locking position by a biasing device and can be unlocked against the bias by a pressure medium cylinder.

17. The quick coupler according to claim 5, wherein the pressure circuit is a common pressure circuit actuating the self-locking securing element at the locking receptacle, and the pressure-medium-actuatable locking element at the coupling receptacle;

wherein the common pressure circuit enables for actuation of the pressure-medium-actuatable locking element of the coupling receptacle and the actuation of the self-locking securing element at the locking receptacle at different pressure levels, such that the pressure-medium-actuatable locking element of the coupling receptacle only is actuatable and/or connectable to the rest of the pressure circuit when a pressure sufficient or provided for the actuation of the self-locking securing element is exceeded or such excessive pressure is applied to a pressure circuit portion leading to the pressure-medium-actuatable locking element.

18. A quick coupler comprising:

a coupling receptacle for receiving a first locking part, the coupling receptacle having a self-locking securing element for one or both of catching or securing the first locking part in the coupling receptacle;

a locking receptacle for receiving a second locking part, the locking receptacle having a pressure-medium-actuatable locking element for locking the second locking part in the locking receptacle;

a pressure circuit actuating both the self-locking securing element and the pressure-medium-actuatable locking element, the pressure circuit having:

an unlocking pressure port;

a locking pressure port; and valve means connectable with one of a pressure source or a return line;

wherein the self-locking securing element is connected with the unlocking pressure port via a first switching valve that opens upon reaching and subsequently exceeding a first pressure; and wherein the valve means further comprises a pressure control means for selectively controlling the pressure applied at the unlocking pressure port to a second pressure greater than the first pressure and to a third pressure less than the first pressure.

19. The quick coupler according to claim 18, wherein the pressure control means is formed such that the actuation of the self-locking securing element of the coupling receptacle is effected at a higher pressure than the actuation of the pressure-medium-actuatable locking element of the locking receptacle; and wherein a portion of the pressure circuit leading to the self-locking securing element is shut off from the rest of the pressure circuit upon actuation of the pressure-medium-actuatable locking element with a lower pressure level.

20. The quick coupler according to claim 19, wherein the pressure control means includes a pressure reducing valve for reducing the second pressure to the third pressure and a switching valve provided upstream of the pressure reducing valve, which switching valve in a first switching position applies the second pressure to the pressure reducing valve and in a second switching position applies the second pressure past the pressure reducing valve to the unlocking pressure port.

21. The quick coupler according to claim 17, wherein the pressure control means includes a pressure reducing valve for reducing the second pressure to the third pressure and a second switching valve provided upstream of the pressure reducing valve; and wherein the valve means is downstream of the pressure reducing valve and includes a third switching valve, which third switching valve in a first switching position passes the third pressure reduced by the pressure reducing valve to the locking pressure port and in a second switching position passes the third pressure reduced by the pressure reducing valve to the unlocking pressure port.

* * * * *